US008201762B2

(12) United States Patent
Koslow

(10) Patent No.: US 8,201,762 B2
(45) Date of Patent: Jun. 19, 2012

(54) SPHERE-PRODUCING/COMMINUTION MACHINE

(76) Inventor: Alexander Koslow, Landshut (DE)

( * ) Notice: Subject to any disclaimer, the term of this patent is extended or adjusted under 35 U.S.C. 154(b) by 0 days.

(21) Appl. No.: 13/004,729

(22) Filed: Jan. 11, 2011

(65) Prior Publication Data

US 2011/0101141 A1 May 5, 2011

Related U.S. Application Data

(63) Continuation of application No. PCT/DE2009/000799, filed on Jun. 6, 2009.

(30) Foreign Application Priority Data

Jul. 25, 2008 (DE) ..... 10 2008 034 724

(51) Int. Cl.
*B02C 17/02* (2006.01)
*B07B 13/00* (2006.01)

(52) U.S. Cl. ..... 241/91; 241/188.1; 241/275

(58) Field of Classification Search ..... 241/275, 241/91, 285.3, 188.1
See application file for complete search history.

(56) References Cited

U.S. PATENT DOCUMENTS

| | | | | |
|---|---|---|---|---|
| 1,706,643 | A * | 3/1929 | Wiley | 241/73 |
| 2,954,175 | A | 9/1960 | Humphrey et al. | |
| 3,419,223 | A * | 12/1968 | Morin | 241/73 |
| 4,198,005 | A * | 4/1980 | Eiff | 241/73 |
| 4,718,614 | A | 1/1988 | Häusler et al. | |
| 5,472,147 | A * | 12/1995 | Doppstadt | 241/88.4 |
| 5,484,110 | A * | 1/1996 | Doppstadt | 241/86.1 |
| 5,743,472 | A * | 4/1998 | Williams et al. | 241/32 |
| 5,911,372 | A * | 6/1999 | Williams, Jr. | 241/32 |
| 6,371,393 | B1 * | 4/2002 | Kohl et al. | 241/73 |
| 7,600,708 | B2 * | 10/2009 | Karlsson et al. | 241/73 |

FOREIGN PATENT DOCUMENTS

| | | | |
|---|---|---|---|
| DE | 3528288 | C1 | 4/1987 |
| DE | 10218994 | A1 | 11/2003 |

OTHER PUBLICATIONS

International Search Report and Translated Opinion; PCT/DE2009/000799; Nov. 10, 2009; 10 pages.

* cited by examiner

*Primary Examiner* — Bena Miller
(74) *Attorney, Agent, or Firm* — St. Onge Steward Johnston & Reens LLC

(57) ABSTRACT

A machine for noduling of metal scrap that can upon conversion be used for comminuting such scrap. Frequently machines for comminuting are constructed by a bipartite frame solely for cleaning purpose. One part is solidly fixed to a foundation while the other one is fixed to the first one by hinges and a locking device, so that it can be turned away from the first part of the frame. To further develop such machines that an exchange of worn components is possible and that simply by conversion and by saving of time, one sort of usage can easily be transferred to another one, the complete rotor-block is mounted together with its bearings on a swivelling arm that can be turned away from the frame of the machine in order to enable free access to the interior of the machine.

1 Claim, 1 Drawing Sheet

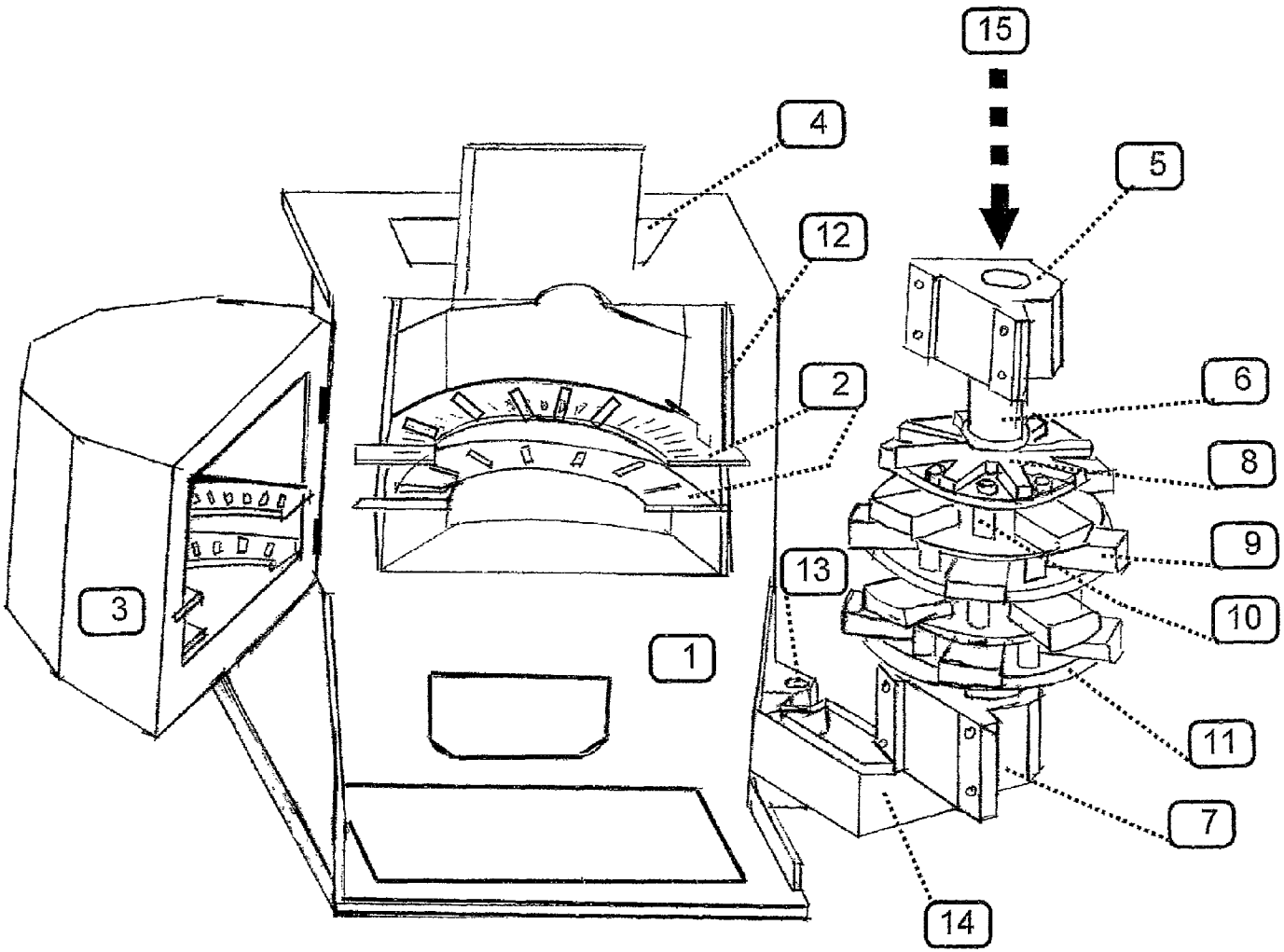
15
5
6
8
9
10
11
7
14
4
12
2
13
1
3

SPHERE-PRODUCING/COMMINUTION MACHINE

CROSS-REFERENCE TO RELATED APPLICATIONS

The present application is a continuation of pending International patent application PCT/DE2009/000799 filed on Jun. 6, 2009, which designates the United States and claims priority from German patent application 10 2008 034 724.8 filed on Jul. 25, 2008, the content of which is incorporated herein by reference.

FIELD OF THE INVENTION

The invention relates to a machine for noduling of metal scrap that can upon conversion be used for comminuting such scrap.

BACKGROUND OF THE INVENTION

Machines for noduling are used to transform metal-scrap into a manageable, easily transportable and material recognisable way in order to detect a basis for a material conform precondition for re-usage of metal-scrap by machines.

Comminuting machines are used in a pre-stage of re-using of metal-scrap in order to transform bulky metal-scrap into a dimension that makes it manoeuvrable, after treatment in a comminuting machine, for further processing by a noduling machine in order to obtain material specific components for re-usage purposes.

It is common to both machine types, since metal-scrap for further treatment is bulky and less suitable for manipulation, metal pieces get jammed or at least prevent operation of such machines by friction if not even stop them completely. For this reason the housing of such machines, in which a rotating rotor equipped with metal hammer-rods is placed, is designed bipartite so that it may be opened for cleaning and maintenance purposes. Each of both machine-types has its characteristics. A conversion of one type of these machines into the other one for noduling and comminuting machines is not possible due to technical reasons up to now.

SUMMARY OF THE INVENTION

One object of this invention is to design a machine that does not simply enable an easy cleaning and replacing of worn out parts but equally enables an easy modification of a noduling machine into a comminuting machine and vice versa.

In order to meet this target this invention recommends to design not only the machine rack bipartite in its central part but also to combine the rotor together with its bearings, the hammer-rods and a stream-up of the hammer-rods placed star-like distributor to a rotor-bloc. This construction unit that rotates centrally in a space of the machine-rack is fixed on a swivelling arm that can be moved out of the machine-rack. Equally for such a machine, when working as a comminuting machine, that needs screens, such screens are divided into halves that when the rotor-block is turned out, they may be mounted or dismantled whenever necessary. Hence, a change from one machine type to the other one is easily and in a time saving manner possible. Similarly that applies to the waved, replaceable covering layers on the interior housing walls of the space inside the machine housing, which are also divided along their middle line.

The screen parts divided along their middle line may, according to the needs, easily be mounted or dismantled from their fixation elements at each half of the housing of the machine when the machine housing is opened and when the rotor block is turned out. Therefore, a change-over from one machine type to the other one is easily and in a time saving manner possible as well as the replacement of worn out screens or other worn out parts as for example the interior waved coverage-layers of the housing that covers all space of the interior wall of the machine rack. Even an exchange of the hammer-rods that are mounted to plates on different levels at the rotor-block does not create any problem, since hammer-rods and their fixing elements are freely accessible at such a construction. Hammer-rods are usually mounted on these plates by bolts and allow an axial moving so that they are slingshot by centrifugal forces when the rotor-axes rotates in such a way that they may work on the metal scrap fed in a manner as wanted.

BRIEF DESCRIPTION OF THE DRAWINGS

FIG. 1 shows the interior space of an open comminuting machine.

DETAILED DESCRIPTION OF THE INVENTION

The FIGURE shows the interior space of an open comminuting machine equipped with screens (2) having two parts, when one part (3) of the machine-rack is turned away to the left, so showing the interior of that part (1) of the machine-rack that is solidly fixed to a foundation from which the rotor-block (15), during operation centrally located, is turned to the right where as the swivelling-arm (14) is pivoted to a bearing (13) firmly attached to the machine-rack (1).

Part (1) of the machine-rack defines a construction part of the machine-rack that is firmly fixed to a foundation, and that embraces one half of the noduling or the comminuting machine together with their interior construction parts that solely depend from the particular usage. The interior side-walls of the noduling machine cover layers (12) that are wavy in the length direction to support the noduling process. The material to be treated is metal scrap that is fed into the machine through a filler opening (4) and then evenly distributed over all of the cross area of the machine by a distributing devise (8) that is firmly fixed to the rotor shaft when put into axial rotation. Mounting plates (11) are also firmly fixed to the rotor shaft on varying vertical levels and to which hammer-rods (9) are mounted that can turn horizontally and that are linked to the mounting plates (11) by bolts (10). When the rotor shaft (6) rotates centrifugal forces move them outward and make them get in contact at the inner wall with the material filled in. Dependant from the equipment of the machine the material filled in will be noduled along the wavy interior wall (12) or put into comminuted fracture by using screen inserts (2). In case screens (2) are paced inside the machine the material filled into the machine will be comminuted into fracture, however, in case that these screens are missing a noduling effect takes place.

In order to facilitate access to the wearing parts of the machine for repairing and to facilitate replacement of these parts the designing of the machine allows that one half (3) of the machine rack can be turned out as well as the total rotor-block (15). Hence, the upper and lower bearings (5 and 7) of the rotor-shaft (6) are mounted to a swivelling arm (14) that is on one side fixed to the machine rack (1) that is strongly anchored to a machine foundation and the swivelling arm (14) being able for axial turning in a hinge (13) to which it is fixed by a bolt.

This construction facilitates a simple modification of this machine from a noduling to a comminuting operation. The mounting and demounting of the screens (2) can be performed without expensive and time absorbing dismantling of the rotor shaft (6). Therefore, a change in operation of the machine from one area to another is possible any time with little impact for changing. That creates from one machine two ones that are different in function.

It is obvious to provide hydraulic, pneumatic or mechanical means for opening or closing of the bipartite machine rack (1 and 3), due to tremendous forces a rigid connection of both parts of the machine rack during operation is inevitable. The same applies to the fixation of the two bearing blocks (5 and 7) for the rotor shaft (6), when being locked at the machine rack for operation of the machine. That may be organised by using well-dimensioned screws, hydraulic, pneumatic or other mechanical locking-devices. This may also be achieved by combining such means.

The hammer-rods (9), which are attached by bolts (10) to the rotor shaft (6) through mounting plates (11) that are located on different levels and which are swinging on varying horizontal levels, cooperate during the noduling process with the interchangeable in length direction waved layers on the inlying walls (12) of the machine rack. During the comminuting process the hammer-rods (9), which are forged of high-tensile steel, cooperate with the screens (2) attached to the machine rack and which are also bipartite and interchangeable and by that it leads to a homogenous comminution of metal scrap to be treated. All screens (2) show over their surface equally distributed openings of different size, which defines the dimension of the produced scrap-iron. All openings of one screen (2) show the same dimension. However, openings of the same screen (2) may also differ from one another. Also screens (2) may be located on different levels and they are arranged in such a way that their level differs from those levels on which the hammer-rods (9) rotate in order to avoid touching of hammer-rods (9) with screens (2). The interior diameter of the screens (2) has a dimension of such size that they are extending towards the interior space of the machine rack (1 and 3) to such an extent, that hammer-rods (9) when rotating move over them in an overlapping manner. However, the outside diameter of the mounting plates (11) is smaller than the core diameter of the screens (2). So touching of both is avoided. The outer diameter of the screens (2) is of such dimension that screens (2) lock into fixing-grooves of the machine-rack (1 and 3). The hammer-rods (9) swing out and move over the screens (2) when the machine is in operation and extend with their exterior rotation circle almost to the wavy interior wall (12), however without touching it.

Should, however, discharging of processed material be stopped due to metal-scrap containing e.g. wires or cables and even a blockage occur than the bipartite machine-rack combined through a hinge and a locking device proves to be an optimum for cleaning purposes and for removal of such hindrances. An opening enables an easy access and a turning out of the rotor-block (15) allows a quick removal of such malfunctioning of the machine.

What is claimed is:

1. A machine for noduling and comminuting having a bipartite machine-rack, one half of it may be turned away over a hinge providing free access to the interior part at which a rotor-shaft, equipped with a plurality of hammer-rods, is located, forming a rotor-block together with all cooperating parts cooperating with the rotor shaft, which is connected to an axial turnable swiveling arm that, allowing an axial turning supported by a joint, is based at the machine-rack firmly anchored to a foundation, wherein a wall of both parts of the bipartite machine-rack which surround the interior space of the machine rack is paneled by two interchangeable, bipartite, lengthily waved layers, wherein on diverting levels in the interior part of the machine-rack interchangeable two-part screens, divided at their middle, are located, and wherein the openings of the screens may differ from one another and define the size of the material processed.

* * * * *